US005947047A

United States Patent [19]

Sigler

[11] Patent Number: 5,947,047

[45] Date of Patent: Sep. 7, 1999

[54] SEACOCK INTERLOCKING

[75] Inventor: James A. Sigler, Perrysville, Ohio

[73] Assignee: Sealand Technology, Inc., Big Prairie, Ohio

[21] Appl. No.: 09/124,088

[22] Filed: Jul. 29, 1998

[51] Int. Cl.[6] ..... B63B 13/00

[52] U.S. Cl. ..... 114/198; 4/431

[58] Field of Search ..... 114/183 A, 184, 114/197, 198; 4/321, 323, 331, 333

[56] References Cited

U.S. PATENT DOCUMENTS

| | | | |
|---|---|---|---|
| 2,158,938 | 5/1939 | Hoerichs | 114/198 |
| 4,177,971 | 12/1979 | Landamore . | |
| 4,697,535 | 10/1987 | Wileman, III . | |
| 5,404,048 | 4/1995 | Panner . | |
| 5,621,924 | 4/1997 | Friedman et al. . | |
| 5,681,148 | 10/1997 | Friedman et al. . | |
| 5,724,908 | 3/1998 | Murray | 114/198 |

*Primary Examiner*—Stephen Avila
*Attorney, Agent, or Firm*—Nixon & Vanderhye, P.C.

[57] ABSTRACT

A boat has a seacock operatively attached to the hull and movable between open and closed positions. The seacock is operatively connected to a discharge pump, which in turn is connected to a sewage holding tank. An electrical switch is actuated in response to the position of the seacock, and control circuitry is connected to the seacock electrical switch and the discharge pump to prevent operation of the pump if the seacock is closed (or in any position aside from fully open). An indicator, such as one or more light emitting diodes, is also actuated in response to the seacock electrical switch position, and another indicator, such as one or more light emitting diodes, is connected to the discharge pump and indicates when that pump is operating. The electrical switch is waterproof and meets marine vessel ignition prevention and electromagnetic compatibility requirements, and typically is actuated in response to the position of a manually actuable (e.g. rotatable) handle of the seacock.

20 Claims, 4 Drawing Sheets

SEACOCK INTERLOCKING

BACKGROUND AND SUMMARY OF THE INVENTION

Virtually all marine vessels (boats) of any size have seacocks, typically which are manually operated. A seacock is a flanged valve that is mounted directly to the inside of a boat hull to provide a leak proof joint around a discharge orifice from inside the hull to outside the hull. Many vessels have more than one seacock, in different sizes, for all different types of overboard discharge applications, and in most cases the seacocks are located in an area of the boat that is not easily accessible to the boat owner or operator. In normal use the seacocks remain in the open position and are closed only when the boat is not used for an extended period of time.

Although seacocks are normally kept open, and perhaps because of that, one of the most frequent mistakes common to marine vessels is to try and discharge through a seacock when it is closed. This is particularly unpleasant and disastrous where the seacock is connected up to a discharge pump which in turn is connected to a tank for holding sewage that has accumulated on the boat. If the discharge pump is actuated when the seacock connected to it is closed, damage to the pump, breakage of the flexible discharge hose connected between the pump and the seacock, and damage to check valves inside the pump, may all occur. Also if the pump is a positive displacement type (which is common) the motor may stall, creating a dangerous amperage overload that a fuse or circuit breaker may not properly prevent.

According to the present invention, a system is provided for either minimizing the possibility of operating the discharge pump when the seacock associated with it is closed, or positively preventing operation of the pump under those circumstances. By utilizing the invention, one of the most common errors in boat start-up operations can thus be avoided, with minimal additional expense.

According to one aspect of the present invention a sewage handling system for use on a boat is provided. The system comprises the following components: A seacock movable from a first, open, position allowing passage of liquid therethrough to a second, closed position precluding the passage of liquid therethrough. A sewage holding tank. A discharge pump. A flexible hose connecting the discharge pump to the seacock so that when the pump is activated the pump pumps sewage from the tank through the seacock. An electrical switch actuated in response to the position of the seacock. And, the electrical switch connected to the discharge pump to substantially prevent operation of the discharge pump if the seacock is in the second, closed, position. Preferably the switch is connected to allow operation of the pump only if the seacock is substantially in the completely open position.

The electrical switch preferably is waterproof, and meets marine vessel ignition prevention and electromagnetic compatibility requirements. Preferably the seacock is manually operated, having a manual handle that is movable between the open and closed positions, the handle actuating the switch in response to the movement thereof. For example the handle may be rotatable about an axis substantially perpendicular to the direction of passage of liquid through the seacock when open, and the switch actuator may be a radial extension of that handle. Preferably the system also comprises an indicator actuated in response to the seacock electrical position, such as at least one light emitting diode, and may also comprise an indicator connected to the discharge pump (again at least one light emitting diode) indicating when the discharge pump is operating.

According to another aspect of the present invention a boat is provided comprising: A hull. At least one seacock operatively attached to the hull and movable from a first, open, position allowing passage of liquid therethrough and through the hull therethrough to a second, closed, position precluding the passage of liquid therethrough. A sewage holding tank. A discharge pump. The sewage tank and discharge pump connected to the seacock so that when the seacock is in the first position thereof, and the pump is activated, the pump pumps sewage from the tank through the seacock. An electrical switch actuated in response to the position of the seacock. And, control circuitry connected to the seacock electrical switch and the discharge pump which prevents operation of the discharge pump if the seacock is in the second, closed, position.

The boat may further comprise a pump control electrical switch connected to the discharge pump and movable to a momentary manual position which requires operator activation of the pump, or an automatic position in which the pump operates automatically once sewage in the tank has reached a predetermined level. Indicators may be provided as described above, and the electrical switch and seacock may also have the characteristics as described above. The control circuitry may prevent operation of the discharge pump unless the seacock is in substantially the first, fully open, position.

According to another aspect of the present invention a boat is provided comprising: A hull. At least one seacock operatively attached to the hull and movable from a first, open, position allowing passage of liquid therethrough and through the hull therethrough to a second, closed, position precluding the passage of liquid therethrough. A sewage holding tank. A discharge pump. The sewage tank and discharge pump connected to the seacock so that when the seacock is in the first position thereof, and the pump is activated, the pump pumps sewage from the tank through the seacock. An electrical switch actuated in response to the position of the seacock. An indicator actuated in response to the seacock electrical switch position. And, an indicator connected to the discharge pump indicating when the discharge pump is operating. The details of the components, as well as the addition of an indicator, pump electrical control switch, etc., preferably are as described above.

It is the primary object of the present invention to effectively and simply minimize the possibility of operating a sewage discharge pump when the seacock associated therewith is closed. This and other objects of the invention will become clear from an inspection of the detailed description of the invention, and from the appended claims.

DETAILED DESCRIPTION OF THE DRAWINGS

Figure 1:
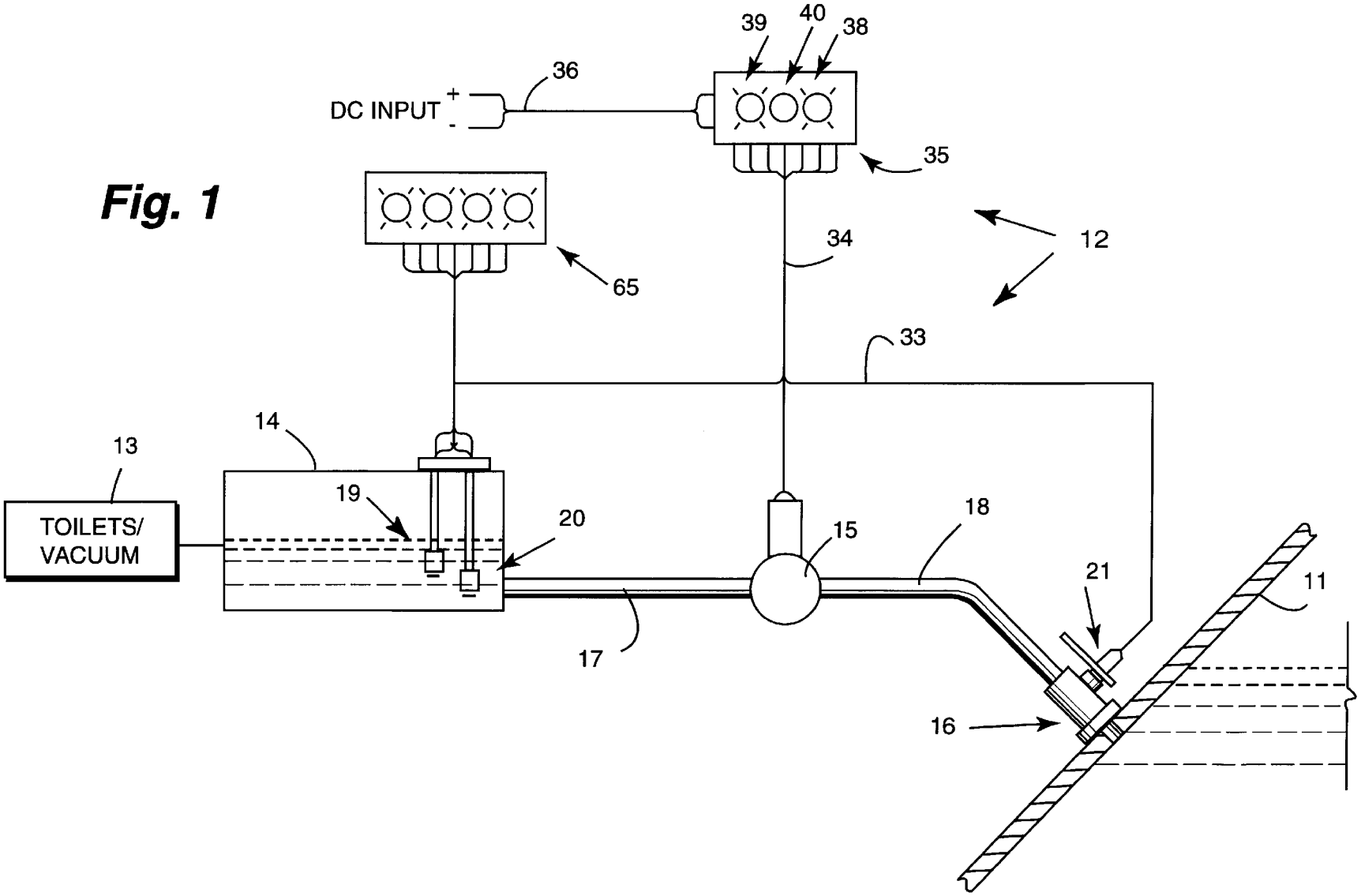
FIG. 1 is a schematic representation of a boat with a system according to the invention.

FIG. 1 illustrates an exemplary system according to the present invention, associated with a boat according to the present invention, in one exemplary form. The boat includes a hull 11, and a system—shown generally by reference numeral 12—according to the present invention is mounted within the hull 11, at any suitable location.

The system 12 includes a sewage handling system, that is associated with one or more toilets, and possibly vacuum sources, 13. While the system 12 may be utilized with any type of sewage handling system 13 that can be mounted within the hull 11, the preferred system is a vacuum system, such as shown in U.S. Pat. Nos. 3,663,970, 4,672,690, 5,408,704, 5,621,924, and/or 5,681,148 (the disclosures of which are hereby incorporated by reference herein).

Regardless of the sewage system 13 utilized, however, it will include a holding tank 14 (which may also be a combined vacuum tank) for holding sewage therein, the tank 14 connected to a conventional electrically operated discharge pump 15, such as a positive displacement pump. A seacock, shown generally by reference numeral 16 in FIG. 1, is operatively attached to the hull 11 and movable from a first, open, position (FIGS. 2 and 3) allowing passage of liquid (e.g. sewage) therethrough and through the hull 11, to a second, closed, position (FIGS. 4 and 5) precluding the passage of liquid therethrough and through the hull 11. Typically the pump 15 is connected to the tank 14 using a flexible hose 17, and the pump 15 is connected to the seacock 16 using another flexible hose section 18. As is also conventional the holding tank 10 includes float activated indicators, or other suitable conventional indicators, such as the floats 19 and 20, which indicate a low level, and substantially empty condition of the holding tank 14.

An electrical switch is provided which is actuated in response to the position of the seacock 16. The electrical switch is shown schematically at 21 in FIG. 1, and in each of FIGS. 2 through 5.

Figure 2:
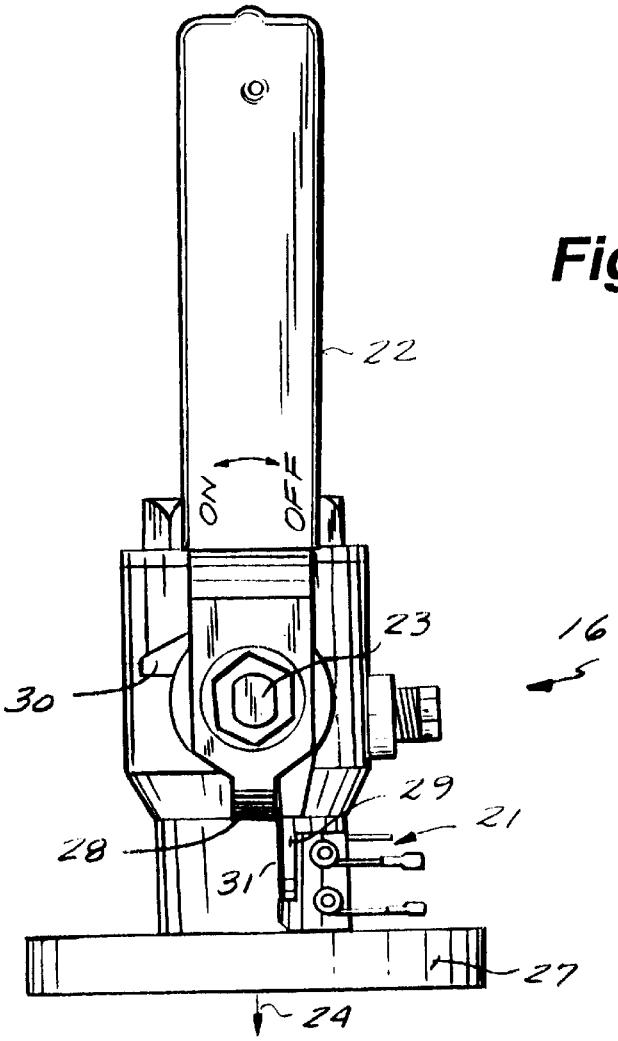
FIGS. 2 and 3 are top and front end views, respectively, of an exemplary seacock utilized in the system of the present invention shown in the open position.
Figure 3:
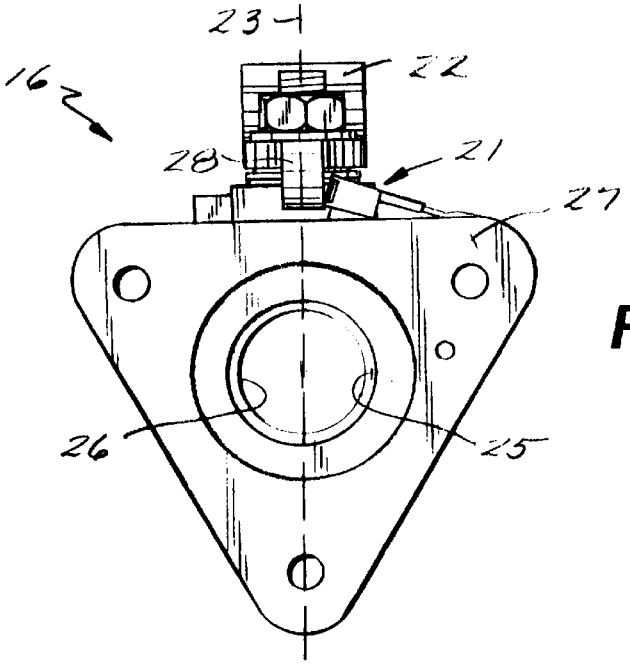
Figure 4:
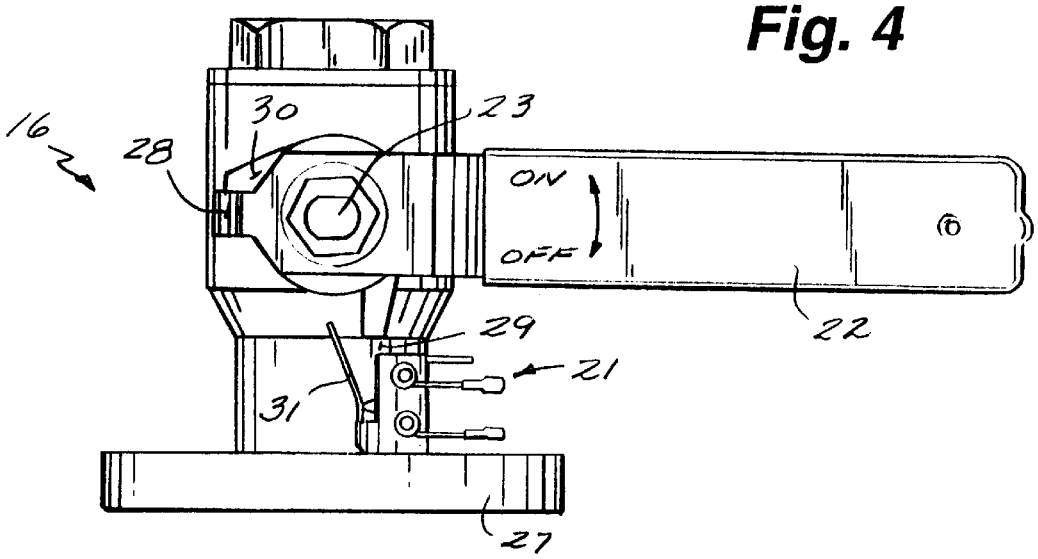
FIGS. 4 and 5 are views like those of FIGS. 2 and 3 only showing the seacock in the closed position.
Figure 5:
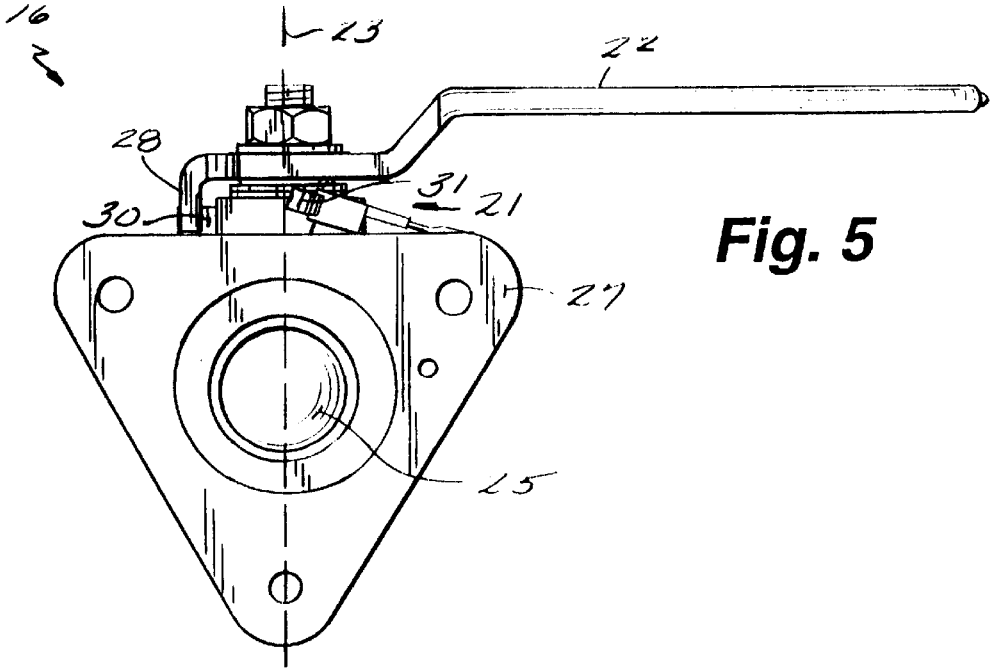

The seacock 16, and the electrical switch 21, may take a wide variety of conventional forms. For example the seacock 16 may be of the type where continued rotation of the handle reciprocates a valve element, such as shown in U.S. Pat. No. 4,177,971. However in the preferred form, the seacock 16 is a conventional full flow ball type, such as sold under the trademark "Apollo" by Conbraco Industries Inc., as illustrated in FIGS. 2 through 5. The seacock 16 illustrated in FIGS. 2 through 5 is manually actuated, having a manually movable handle 22 that is rotatable about an axis 23 which is substantially perpendicular to the direction of flow of sewage—shown schematically at 24 in FIG. 2, and extending out of the plane of the paper in FIG. 3—when the ball valve 25 of the seacock 16 is open, as illustrated in FIGS. 2 and 3. The ball valve 25 has an internal passageway 26 through which the sewage flows when the valve 25 is open (as in FIGS. 2 and 3). When the ball valve 25 is moved to the closed position (FIGS. 4 and 5) it precludes passage of liquid therethrough. The flange 27 is for mounting the seacock 16 to the hull 11, and it may be internally threaded to receive in a leak-tight manner a conduit passing through the hull 11, as is conventional.

The electrical switch 21 (e.g. a microswitch) is preferably mounted with respect to the handle 22 so that the switch 21 is actually physically activated by a position of the handle 22. For example for the exemplary seacock 16 illustrated in FIGS. 2 through 5, which has a metal projection 28 extending outwardly from the handle 22, and which cooperates normal with metal stationary stops 29, 30 which stop the actuator 22 in the open (FIGS. 2 and 3) and closed (FIGS. 4 and 5) positions, respectively, the electrical switch 21 position can be made responsive to the movement of the element 28. For example in the exemplary embodiment illustrated in FIGS. 2 through 5, the electrical switch 21 is mounted on the seacock 16 housing adjacent or on the stop 29. The switch 21 actuating lever 31 is depressed, in turn depressing a push button, when the handle 22 is in the position illustrated in FIGS. 2 and 3, and is moved outwardly under its own inherent flexibility or spring pressure so that it does not depress the push button when the handle 22 is in the position illustrated in FIGS. 4 and 5. Alternatively, however, the switch 21 may be mounted on or adjacent the stop 30, or it may be mounted by some separate mechanism (such as a clamp) on the seacock 16 as a retrofit. The position illustrated in the drawings is preferred because that means the seacock 16 must be substantially completely open before pump 15 can run.

The electrical switch 21 may be any suitable type of electrical switch, and is shown only schematically as a microswitch in FIGS. 2 through 5. For example it may be a Hall (magnetic reed) switch which is operated by magnetic influences and not by a manual actuator at all; or other types of condition responsive switches may be used. Regardless of the type, however, the switch 21 preferably is mechanically actuated waterproof switch which meets marine vessel ignition prevention and electromagnetic compatibility requirements, such as sold by Control Products Inc. of East Hanover, N.J.

The system 12 further comprises control circuitry connected to the seacock electrical switch 21 and the discharge pump 15 which prevents operation of the discharge pump if the seacock 16 is in the closed position (FIGS. 4 and 5), or in any position besides substantially completely open (FIGS. 2 and 3). The circuitry includes the electrical connectors 33, 34 extending from the switch 21 and the pump 15, respectively, to a circuitry/control box or panel 35 (see FIG. 1) to which power is input via line 36. The control circuitry also is illustrated schematically by reference numeral 37 in FIG. 6 in one exemplary form according to the invention. While an exemplary form of the circuitry is illustrated at 37 in FIG. 6, it is to be understood that any conventional circuitry which accomplishes the objectives of the discharge pump 15 remaining inoperable if the seacock 16 is in the closed position (or, alternatively, in any position aside from the completely open position of FIGS. 2 and 3) may be provided.

Figure 6:
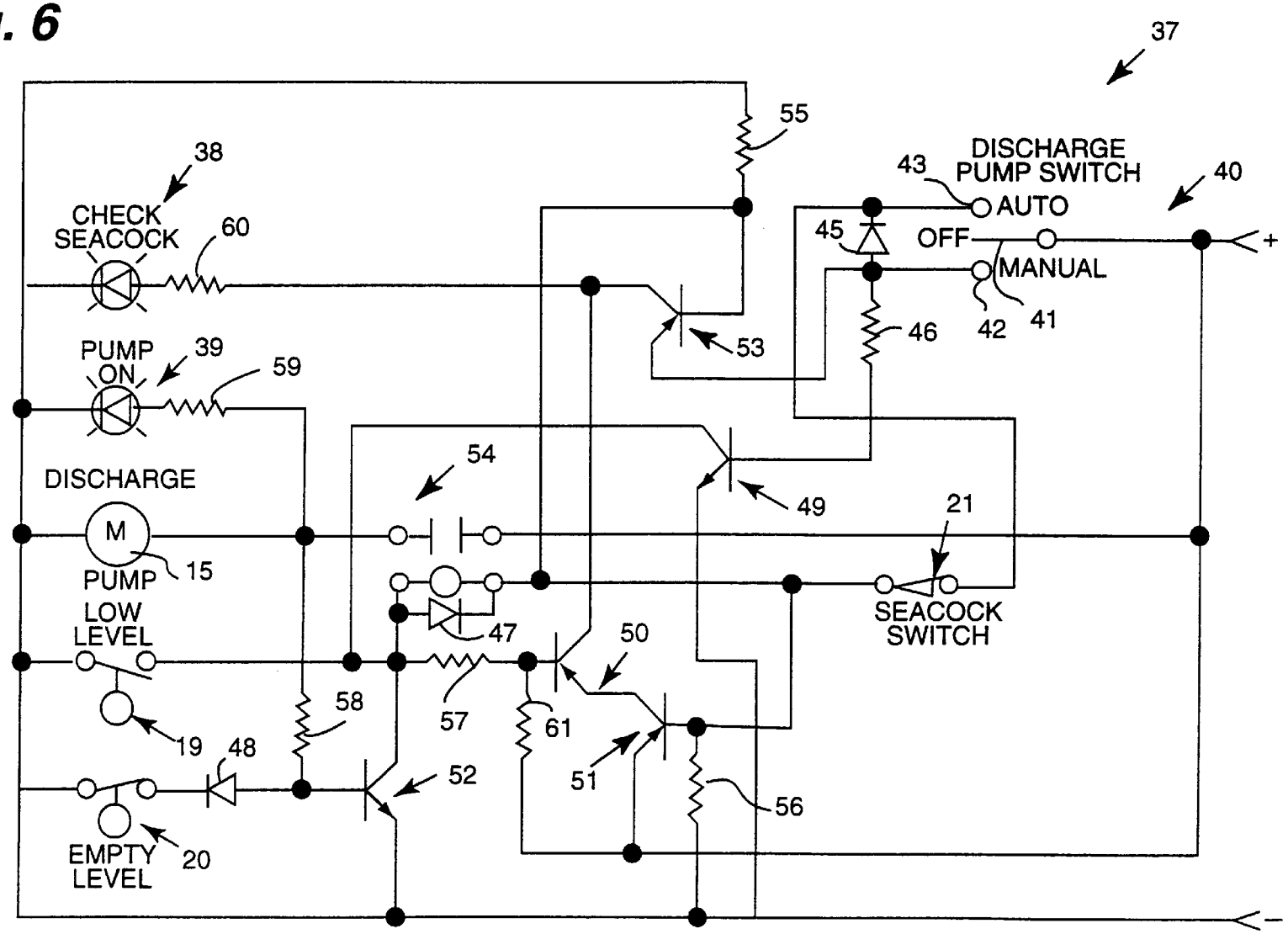
FIG. 6 is an electrical schematic illustrating exemplary circuitry that may be utilized in the system according to the present invention.

The circuitry 37, as an alternative or in addition to providing the positive interlock preventing operation of the pump 15 unless the seacock 16 is in the appropriate position, may include an indicator, shown schematically at 38 in FIGS. 6 and 1, which is actuated in response to the seacock electrical switch 21 position. In the preferred embodiment illustrated in FIG. 6, the indicator 38 comprises a single light emitting diode, although more than one light emitting diode, a light bulb, and/or a horn, or like indicators, may be utilized. If the indicator 38 is energized, that indicates that the position of the seacock 16 should be checked since it is likely closed, or at least not fully open, because the switch 21 has not been actuated by the actuator 28.

According to the present invention a second indicator 39 may also be provided indicating that the pump 15 is operating. The indicator 39 may also comprise any suitable indicator as described above with respect to the indicator 38, but preferably comprises a single light emitting diode as illustrated in FIGS. 6 and 1.

The circuitry 37 also preferably comprises a pump 15 control switch, shown schematically at 40 in FIG. 6. The control switch 40 includes an actuator 41 which may be moved to a manual position 42 which requires manual operation of the pump (as by moving the element 41 into and out of contact with the contact 42 defining the manual position), or to an automatic position electrical contact 43 in which the pump 15 operates automatically in response to the amount of sewage in the tank 14.

Figure 7:
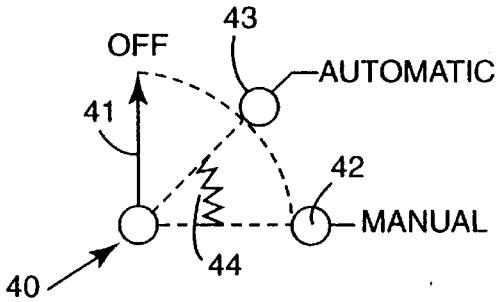
FIG. 7 is a schematic of another form that the automatic/manual pump control switch may have according to the present invention.

An alternative construction for the switch 40 is illustrated in FIG. 7. In FIG. 7 the actual structural components are the same as in FIG. 6 therefore the structures are given the same reference numeral. The only thing different is the arrangement of the elements. In the FIG. 7 embodiment, the movable contact 41 can be moved from a maintained off position (solid line in FIG. 7) to a maintained automatic position in contact with a contact 43, to a momentary manual position in contact with contact 42. In the momentary manual position a spring, shown schematically at 44, biases the movable contact 41 to the automatic position. As long as the operator holds the movable contact 41 in contact with the manual contact 42 the pump 15 will operate; however as soon as the operator removes his or her hand from the movable contact 41, the spring 44 will return it to the automatic position 43. Though not illustrated in FIG. 6, the switch 40 may also—and preferably does—have a momentary operation, spring biasing the movable contact 41 away from the manual contact 42.

Associated with the low level and empty switches 19, 20 there also are preferably level indicator lights (not shown), e.g. on the panel 35, such lights being conventional. Also as conventional, at least the low level actuator 19, and perhaps the empty actuator 20 (both of which may be magnetic reed switches) are attached to a "rough sea" time delay network. The conventional time delay circuitry delays about three seconds before energization of the circuitry components 37 by either of the switches 19, 20 in order reduce pump 15 cycling that may occur from sewage "sloshing" in the holding tank 14. That is the low level switch 19 must be closed for three seconds before the discharge pump 15 will start in the automatic mode.

In the circuitry 37 in FIG. 6, a first diode 45 is associated with a resistor 46, and second and third diodes 47, 48, respectively, are also provided. The circuitry 37 also includes five transistors, illustrated at 49, 50, 51, 52, and 53, a conventional relay 54 having relay contacts, and a plurality of other resistors namely 55, 56, 57, 58, 59, 60, and 61. Operation of the circuitry 37, in one preferred form, is as follows:

The pump 15 will run in the manual mode (41, 42) regardless of the position of the level floats 19, 20. The manual mode (41, 42) bypasses all but the seacock interlock switch 21.

When the pump switch 40 is in the automatic mode (41, 43) the pump 15 will start only when the low level float switch 19 closes. After the pump 15 starts the liquid level drops and the low level switch 19 opens. However, the pump 15 will continue to run until the empty level switch 20 closes. The empty level switch 20, relay 54, and transistor 52, provide a "latching circuit" for the automatic mode (41, 43).

In the manual mode (41, 42) if the seacock 16 is open, the circuitry 37 functions as follows:

+12 volts current passes through the diode 48 and the seacock switch 21 to the coil of relay 54 and to the base of the transistor 53, holding 53 off.

+12 volts current passes through the resistor 46 to the base of the transistor 49 turning 49 on.

−12 volts current passes through the transistor 49 energizing relay 54.

Relay 54 contacts close supplying +12 volts to the pump 15 motor and the "pump on" LED 39, running pump 15 and turning LED 39 on.

In the manual mode (41, 42) with the seacock 16 closed, the circuitry 37 functions as follows:

+12 volts current passes to the emitter of the transistor 53.

+12 volts current passes through the diode 48 to the coil of the relay 54 but is interrupted by the seacock switch 21 preventing relay 54 from energizing.

−12 volts current passes through the resistor 55 to the base of the transistor 53 and turns 53 on.

+12 volts current passes through the transisitor 53 and turns the "check seacock" LED 38 on.

In the automatic mode (41, 43) with the seacock 16 open, the circuitry 37 functions as follows:

+12 volts current passes through the seacock switch 21 to the coil of relay 54.

+12 volts current passes to the base of transistor 53 holding 53 and the "check seacock" LED 38 off.

When the liquid level rises above the empty float switch 20 the contacts break, nothing happens yet.

When the liquid level rises above the low level float switch 19, -12 volts is present at the coil of the relay 54 energizing 54.

+12 volts current passes through the closed contacts of the relay 54 and turns on the pump 15 motor, the "pump on" LED 39, and the transistor 52.

The transistor 52 provides −12 volts to the coil of the relay 54 holding the relay 54 energized after the liquid level drops below the low level switch 19 when the low level switch 19 contacts open.

When the liquid level drops below the empty float switch 20 its contacts close and turn off the transistor 52 deenergizing the relay 54.

The relay 54 contacts break turning off the pump 15 motor and the "pump on" LED 39.

In the automatic mode (41, 43) with the seacock 16 closed the circuitry 37 functions as follows:

+12 volts is supplied to the coil of the relay 54 but is interrupted by the seacock switch 21.

When the liquid rises above the low level float switch 19, −12 volts is supplied through the resistor 57 to the base of the transistor 50.

Transistors 50 and 51 turn on supplying +12 volts to the "check seacock" LED 38, energizing it.

While it is preferred that the seacock 16 is manually actuated, a solenoid actuator may be provided therefor, and the circuitry arranged so that if operation of the discharge pump 15 is attempted while the seacock 16 is closed, the control circuitry would automatically actuate the solenoid to move the seacock 16 to the fully open (FIGS. 2 and 3) position, at which point operation of the pump 15 would then be allowed.

The tank 14 may also have other conventional level indicators (e.g. see the "¾" and "full" level indicators in U.S. Pat. No. 5,681,148) associated therewith, and a tank level indicator display 65 (see FIG. 1). One or more of the other (e.g. "full") level indicators can also be connected to the circuitry 37 in place of, or in addition to, the indicator 19.

It will thus be seen that according to the present invention a simple yet effective indicator and/or interlock system associated with a sewage handling system on a boat have been provided. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A boat comprising:

a hull;

at least one seacock operatively attached to the hull and movable from a first, open, position allowing passage of liquid therethrough and through said hull therethrough to a second, closed, position precluding the passage of liquid therethrough;

a sewage holding tank;

a discharge pump;

said sewage tank and discharge pump connected to said seacock so that when said seacock is in said first position thereof, and said pump is activated, said pump pumps sewage from said tank through said seacock;

an electrical switch actuated in response to the position of said seacock; and control circuitry connected to said seacock electrical switch and said discharge pump which prevents operation of said discharge pump if said seacock is in said second, closed, position.

2. A boat as recited in claim 1 further comprising a pump control electrical switch connected to said discharge pump and movable to a momentary manual position which requires operator activation of said pump, or an automatic position in which said pump operates automatically once sewage in said tank has reached a predetermined level.

3. A boat as recited in claim 1 further comprising an indicator actuated in response to said seacock electrical switch position.

4. A boat as recited in claim 3 wherein said indicator comprises at least one light emitting diode.

5. A boat as recited in claim 3 further comprising an indicator connected to said discharge pump indicating when said discharge pump is operating.

6. A boat as recited in claim 5 wherein said discharge pump operation indicator comprises at least one light emitting diode.

7. A boat as recited in claim 1 wherein said seacock is manually operated, having a manually operated handle, and wherein said electrical switch is mounted in the path of movement of said manually activated handle.

8. A boat as recited in claim 7 wherein said manually actuatable handle is rotatable about an axis of rotation substantially perpendicular to the direction of flow of liquid through said seacock when in said open position.

9. A boat as recited in claim 1 wherein said electrical switch is waterproof and meets marine vessel ignition prevention and electromagnetic compatibility requirements.

10. A boat as recited in claim 2 wherein said electrical switch is waterproof and meets marine vessel emission prevention and electromagnetic compatibility requirements; and wherein said control circuitry prevents operation of said discharge pump unless said seacock is substantially completely open.

11. A boat as recited in claim 1 wherein said control circuitry prevents operation of said discharge pump unless said seacock is substantially completely open.

12. A boat comprising:

a hull;

at least one seacock operatively attached to the hull and movable from a first, open, position allowing passage of liquid therethrough and through said hull therethrough to a second, closed, position precluding the passage of liquid therethrough;

a sewage holding tank;

a discharge pump;

said sewage tank and discharge pump connected to said seacock so that when said seacock is in said first position thereof, and said pump is activated, said pump pumps sewage from said tank through said seacock;

an electrical switch actuated in response to the position of said seacock;

an indicator actuated in response to said seacock electrical switch position; and an indicator connected to said discharge pump indicating when said discharge pump is operating.

13. A boat as recited in claim 12 wherein said indicators each comprise at least one light emitting diode.

14. A boat as recited in claim 12 wherein said electrical switch is waterproof and meets marine vessel emission prevention and electromagnetic compatibility requirements.

15. A boat as recited in claim 12 further comprising a pump control electrical switch connected to said discharge pump and movable to a momentary manual position which requires operator activation of said pump, or an automatic position in which said pump operates automatically once sewage in said tank has reached a predetermined level.

16. A sewage handling system for use on a boat, comprising:

a seacock movable from a first, open, position allowing passage of liquid therethrough to a second, closed position precluding the passage of liquid therethrough;

a sewage holding tank;

a discharge pump;

a flexible hose connecting said discharge pump to said seacock so that when said pump is activated said pump pumps sewage from said tank through said seacock;

an electrical switch actuated in response to the position of said seacock; and said electrical switch connected to said discharge pump to prevent operation of said discharge pump if said seacock is in said second, closed, position.

17. A system as recited in claim 16 wherein said electrical switch is waterproof and meets marine vessel ignition prevention and electromagnetic compatibility requirements.

18. A system as recited in claim 17 wherein said seacock is manually operated, having a manually operated handle, and wherein said electrical switch is mounted in the path of movement of said manually activated handle.

19. A system as recited in claim 18 wherein said manually actuatable handle is rotatable about an axis of rotation substantially perpendicular to the direction of flow of liquid through said seacock when in said open position, and wherein said electrical switch is positioned for actuation when said handle moves to a substantially completely open position of said seacock.

20. A system as recited in claim 16 further comprising at least one light emitting diode indicator actuated in response to said seacock electrical switch position.

* * * * *